US005263851A

United States Patent [19]

Hosome et al.

[11] Patent Number: 5,263,851

[45] Date of Patent: Nov. 23, 1993

[54] COMBUSTION CONTROL SYSTEM FOR BURNER

[75] Inventors: Kazunari Hosome; Syuji Iida; Kazuya Tomatu; Toshiji Tachibana, all of Toyota, Japan

[73] Assignee: Toyota Jidosha Kabushiki Kaisha, Toyota, Japan

[21] Appl. No.: 880,639

[22] Filed: May 8, 1992

[30] Foreign Application Priority Data

May 10, 1991 [JP] Japan ..... 3-135832

[51] Int. Cl.[5] ..... F23N 5/08

[52] U.S. Cl. ..... 431/79; 431/63; 431/76

[58] Field of Search ..... 431/79, 76, 63, 15, 431/13, 14, 78

[56] References Cited

U.S. PATENT DOCUMENTS

| | | | |
|---|---|---|---|
| 4,410,266 | 10/1983 | Seider | 431/79 |
| 4,477,245 | 10/1984 | Giachino et al. | 431/79 |
| 4,934,926 | 6/1990 | Yamazaki et al. | 431/79 |
| 5,049,063 | 9/1991 | Kishida et al. | 431/79 |

FOREIGN PATENT DOCUMENTS

| | | |
|---|---|---|
| 63-105315 | 5/1988 | Japan . |
| 63-105316 | 5/1988 | Japan . |
| 63-105320 | 5/1988 | Japan . |
| 63-105321 | 5/1988 | Japan . |
| 63-105322 | 5/1988 | Japan . |
| 63-105323 | 5/1988 | Japan . |
| 63-105324 | 5/1988 | Japan . |
| 63-108116 | 5/1988 | Japan . |
| 63-169423 | 7/1988 | Japan . |
| 63-273726 | 11/1988 | Japan . |
| 63-306310 | 12/1988 | Japan . |
| 1-167522 | 7/1989 | Japan . |
| 1-167523 | 7/1989 | Japan . |
| 2-8613 | 1/1990 | Japan . |
| 2-178517 | 7/1990 | Japan . |
| 2-254219 | 10/1990 | Japan . |
| 2-302520 | 12/1990 | Japan . |
| 3-36420 | 2/1991 | Japan . |
| 3-137420 | 6/1991 | Japan . |
| 3-164614 | 7/1991 | Japan . |
| 3-170717 | 7/1991 | Japan . |
| 3-170718 | 7/1991 | Japan . |
| 4-68213 | 3/1992 | Japan . |

OTHER PUBLICATIONS

Toyota Technical Review, vol. 41, No. 2, Dec. 1991, entitled "Study of an Optical Frequency Type Combustion Control Method".

Extract of Advance scripts for 29th Combustion Symposium, held at National Kyoto International Hall on Dec. 9, 1991.

*Primary Examiner*—James C. Yeung

*Attorney, Agent, or Firm*—Finnegan, Henderson, Farabow, Garrett & Dunner

[57] ABSTRACT

A combustion control system for a burner having an analog circuit unit which includes a photosensor for detecting combustion flame of the burner, an amplifier for amplifying a detection output from the photosensor, a rectifier for rectifying the amplified signal to a DC component, and an integrator for smoothing the rectified signal to obtain an oscillating power signal. The control system further has a potentiometer for generating an output voltage corresponding to a degree of opening of a fuel flow control valve of the burner, a digital circuit unit supplied with an output signal from the potentiometer and an output signal from the integrator to compare these signals with a plurality of preset combustion state reference values and to output a normal combustion state signal, an incomplete combustion state signal or a flame failure signal in accordance with the result of the comparison, and a controller for outputting either a burner combustion maintaining signal or a burner combustion suspending signal on the basis of the output signal from the digital circuit unit.

5 Claims, 5 Drawing Sheets

COMBUSTION CONTROL SYSTEM FOR BURNER

BACKGROUND OF THE INVENTION

1. Field of the Invention

The present invention relates to a burner combustion control system which may be effectively applied, for example, to a radiant tube burner having a double-casing structure.

2. Description of Prior Art

It is desirable for a burner that burns a liquid or gaseous fuel to maintain an optimal combustion state during the burning operation. Prior arts for such combustion control include one in which the intensity of light emitted from the flame of a burner is detected in the form of an electric signal by using a semiconductor device, e.g., a phototransistor, a photodiode or a solar cell, and combustion control is effected by use of the integral value of a power spectrum that is obtained by frequency analysis of an oscillating waveform of light from the flame on the basis of the output current from such a semiconductor device. According to another prior art, the intensity of light emitted from the burner flame is detected in the form of an ionic current by using an electrode that is inserted into the flame in place of the sensor. The former prior art, that is, the method wherein light emitted from the flame is detected as an electric signal and this signal is processed in an electric circuit, uses a semiconductor photosensor, e.g., a phototransistor, a photodiode, etc., to detect the light from the flame. In this case, if the photosensor is not provided at a proper position, favorable control may not be realized.

Under these circumstances, the present inventor developed and proposed a technique for solving the above-described problem (see Japanese Patent Laid-Open (KOKAI) No. 3-170717). With this technique, oscillating light from the combustion flame is detected with a photosensor, which is provided on the side opposite to the burner, that is, in the rear part of the furnace because it is necessary to detect the whole turbulent burning portion of the flame even when the flame length changes owing to turndown control. However, there are cases where the photosensor cannot be attached to the side opposite to the burner because of the furnace structure; therefore, the desired effect cannot always be expected.

Japanese Patent Laid-Open (KOKAI) No. 3-170718 discloses a combustion control system which is free from the above-described problems. In this invention, an electrode is inserted into the flame from the burner nozzle side to detect a flame ionic oscillating current, thereby making the control system free from the restriction by the furnace structure. However, even such a control system, in which an ionic current is detected with an electrode, is inadequate for some burners, for example, radiant tube burners, wherein flame is formed inside the inner casing of a double-casing structure and radiation from the outer casing is utilized. That is, since such burners are arranged to suck combustion gas from an exhaust port by using an ejector or the like in order to enable continuous combustion, the flame point changes owing to turndown control, so that detection cannot be effected for a specific portion of the flame even with an electrode.

FIG. 7 schematically shows related art (Japanese Patent Application Laid Open No. Hei 4-68213) which is an improvement over the combustion control system for the burner combustor of the type described above and on which the invention of this application is based.

FIG. 7 will be explained below. The burner has a double-casing structure comprising an outer casing 1 and an inner casing 2, and a gas nozzle 3 is provided inside the inner casing 2. A fuel supply pipe 5 is connected to the gas nozzle 3 through a fuel shut-off valve 4 to supply fuel 6 to the nozzle 3. The proximal end portion of the inner casing 2 is provided with an inspection port 7, and a lens 8 is set in the port 7, thereby enabling flame 9 in the inner casing 2 to be monitored.

An optical fiber bundle 11 is disposed such that one end thereof is coincident with a focal point 10 of the lens 8, and a photosensor 12 is attached to the other end of the optical fiber bundle 11. A signal output from the photosensor 12 is amplified in an amplifier 13, rectified in a rectifier 14, integrated in an integrator 15 and then input to a low-limit comparator 16 and a high-limit comparator 17. The low- and high-limit comparators 16 and 17 compare the signal from the integrator 15 with a low-limit voltage 18 and a high-limit voltage 19, respectively. When the signal from the integrator 15 is lower than the low-limit voltage 18, the low-limit comparator 16 turns on, whereas, when the signal from the integrator 15 exceeds the high-limit voltage 19, the high-limit comparator 17 turns on. When either of the comparators 16 and 17 turns on, it introduces the output signal from the integrator 15 to a logical operator 20 in the subsequent stage, the output terminal of the operator 20 being connected to the fuel shut-off valve 4. In the figure, reference numeral 21 denotes an exhaust gas discharge section, 22 combustion gas, 23 an air supply pipe, and 24 combustion air. In addition, a swirler 25 is attached to the distal end portion of the gas nozzle 3.

In the combustion controller for the combustor, the inside of the inner casing 2 is monitored with the photosensor 12 through the lens 8 and the optical fiber bundle 11. A signal output from the photosensor 12 is input to the logical operator 20 through the light oscillating power detecting circuit to output a signal for the open-close control of the fuel shut-off valve 4 in cooperation with the output signal from the integrator 15.

The above-described prior art suffers from some problems stated below: In the above combustion controller, a value output from the integrator 15, that is, a voltage obtained by rectifying and integrating the light oscillating signal, is compared with the low- and high-limit voltages 18 and 19 in the low- and high-limit comparators 16 and 17, respectively, and since these reference voltages are set in a hardware manner, each can be set only at a single reference point, which gives rise to problems: For example, in the case of a burner with a turndown ratio, the above-described integrated voltage varies to a great extent according to the burning rate and the reference voltage employed for detection of incomplete combustion also varies with the burning rate; therefore, the above-described combustion controller cannot be used for a burner with a turndown ratio.

In addition, it is possible to adjust the time constant of the integrator 15 and the low- and high-limit voltages 18 and 19 used as references in conformity to a burner to which the above-described control system is to be applied: for example, in the case of the time constant of the integrator 15, the capacitor is replaced with another to adjust variations in the detection time and the integrated voltage. However, since the capacitance of each individual capacitor is standardized, it is not always possible to obtain an optimal capacitance. In addition, since the controller is an analog circuit, it is extremely difficult to effect fine adjustment by changing capacitors.

In view of the above-described circumstances, it is an object of the present invention to provide a burner combustion control system which is applicable to even a burner with a turndown ratio and which has a detector capable of detecting a combustion state of the burner accurately and also enables a target combustion state to be maintained on the basis of the result of the detection.

SUMMARY OF THE INVENTION

To attain the above-described object, the present invention provides a combustion control system for a burner, comprising: an analog circuit unit including a photosensor for detecting combustion flame of the burner, an amplifier for amplifying a detection output from the photosensor, a rectifier for rectifying the amplified signal to a DC component, and an integrator for smoothing the rectified signal to obtain an oscillating power signal; a potentiometer for generating an output voltage corresponding to a degree of opening of a fuel flow control valve of the burner; a digital circuit unit supplied with an output signal from the potentiometer and an output signal from the integrator to compare these signals with a plurality of preset combustion state reference values and to output a normal combustion state signal, an incomplete combustion state signal or a flame failure signal in accordance with the result of the comparison; and a controller for outputting either a burner combustion maintaining signal or a burner combustion suspending signal on the basis of the output signal from the digital circuit unit.

By virtue of the above-described arrangement, the digital circuit unit receives an output signal from the potentiometer and an output signal from the integrator and compares these signals with a plurality of set reference values. Accordingly, the control system can be applied to a burner with a turndown ratio, which has heretofore been impossible to control by the above-described prior art. In addition, since setting of a time constant, a control value and a flame failure level, for example, can be effected on software, these can be set readily and with high resolution.

DETAILED EXPLANATION OF THE PREFERRED EMBODIMENT

Figure 1:
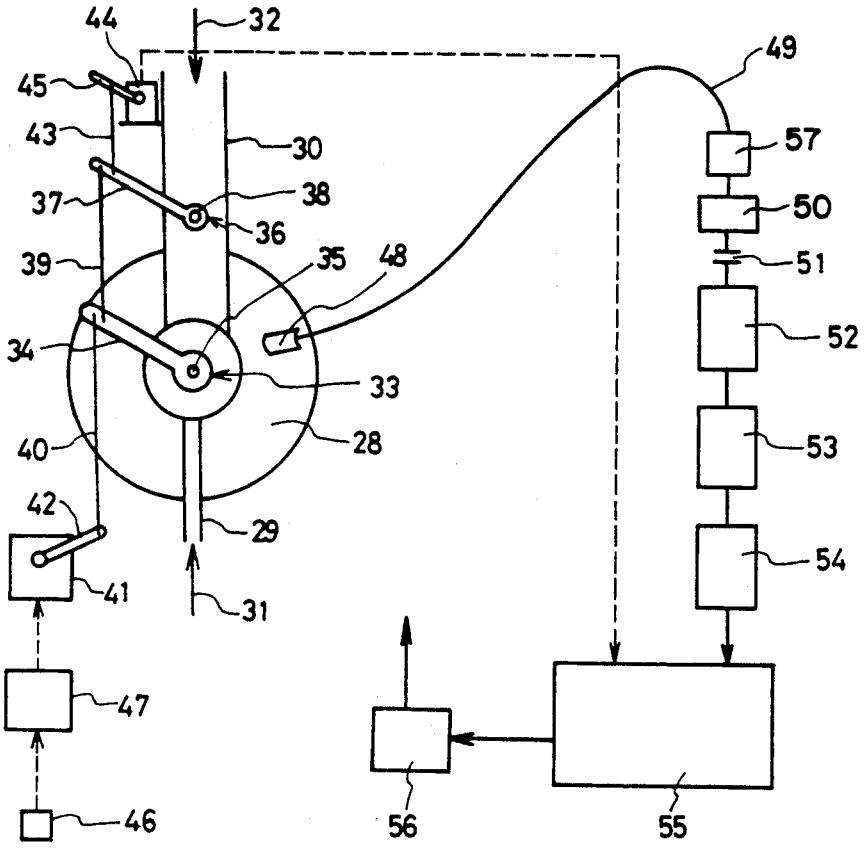
FIG. 1 is a circuit diagram of one embodiment of the present invention.

One embodiment of the burner combustion control system according to the present invention will be described below with reference to FIG. 1. In this embodiment, the present invention is applied to a drying furnace in which the interior of the furnace is heated directly with combustion gas. A radiant tube burner 28 is an ordinary nozzle mixing gas burner in which gas and combustion air are mixed together in the nozzle. The combustion control system of the present invention has a combustion state detector for the burner 28 as its main constituent element. Properly speaking, it is most preferable to detect the whole flame from behind to obtain characteristics shown in FIG. 2 by detecting the continuous turbulent burning portion of the flame with a photosensor. However, it is impossible in the drying furnace to detect the flame from behind due to the furnace structure; therefore, a flame detecting port 48 is provided at a position where a conventional flame detector (e.g., an ultravision) has heretofore been installed, thereby effecting flame detection.

The burner 28 is connected with a fuel supply pipe 29 and an air supply pipe 30 to supply a fuel 31 and combustion air (primary air) 32. Secondary air is also supplied from the periphery of the nozzle. A fuel flow control valve 33 allows the flow rate of fuel to be controlled by pivoting a fuel flow control arm 34 about a shaft 35.

As shown in FIG. 1, the air supply pipe 29 is provided with an air flow control valve 36 which allows the air flow rate to be controlled by pivoting an air flow control arm 37 about a shaft 38. The fuel flow control arm 34 and the air flow control arm 37 are connected to each other through a rod 39. The fuel flow control arm 34 is connected to an arm 42 of a control motor 41 through a rod 40. The air flow control arm 37 is connected to an arm 45 of a potentiometer 44 through a rod 43.

With this structure, as the control motor 41 is activated to rotate, the fuel flow control valve 33 and the air flow control valve 36 are opened in interlocking relation to each other, and the degree of opening of these valves is output from the potentiometer 44. The control motor 41 is activated in response to a signal output from a thermoregulator 47 to which a signal from a temperature sensor 46 is input, to control the fuel and air flow control valves 33 and 36 in association with each other so as to maintain the furnace temperature of the burner 28 at a constant level.

The burner 28 is provided with a flame detecting port 48. One end of an optical fiber bundle 49 is secured to the flame detecting port 48. The other end of the optical fiber bundle 49 is disposed to face a photosensor 57 provided in a DC voltage changer 50. The reason for the use of the optical fiber bundle 49 is to separate and protect the photosensor, which comprises a semiconductor device, e.g., a germanium photodiode, from the heat source because the photosensor is readily affected by heat.

The output terminal of the DC voltage changer 50 is connected to the input terminal of an amplifier 52 through a coupling capacitor 51 that cuts off the DC component from the output signal from the DC voltage changer 50. The output terminal of the amplifier 52 is connected to a rectifier 53, and the output terminal of the rectifier 43 is connected to an integrator 54, thereby effecting rectification, smoothing and integration of the amplified signal. The elements up to the integrator 54 constitute in combination an analog circuit unit.

A digital circuit unit 55 is supplied with the output signal (integrated voltage signal) from the integrator 54 and the output signal from the potentiometer 44. The digital circuit unit 55 compares these signals with a plurality of set values, decides a combustion state from the result of the comparison and displays as well as outputs the result of the decision. There are three different kinds of combustion state decision output, that is, normal combustion output DO1, incomplete combustion output DO2 and flame failure output DO3. The output from the circuit 55 is input to a controller 56 to output either a burner combustion maintaining or suspending signal.

Characteristics of the rectified integrated voltage of the combustion flame light oscillating signal with respect to the excess air ratio will be explained below with reference to FIG. 2. The rectified integrated voltage has a bell-shaped characteristic curve with respect to the excess air ratio. The rectified integrated voltage is a parameter representative of the intensity of fluctuation of the flame. Other parameters that show a similar tendency with respect to the excess air ratio include turbulent burning velocity. It is known that the turbulent burning velocity shows a bell-shaped characteristic curve with respect to the excess air ratio according to the Arrhenius' rule of reaction rate. As a turbulence parameter, turbulent Raynold's number is known. Since the turbulent burning velocity and the turbulent Raynold's number are substantially proportional to each other, the rectified integrated voltate, i.e., the oscillating power, and the turbulent burning velocity are parameters which show a similar tendency with respect to a change in the combustion state, and it is a general tendency that the oscillating power shows a bell-shaped characteristic curve with respect to the excess air ratio.

Figure 2:
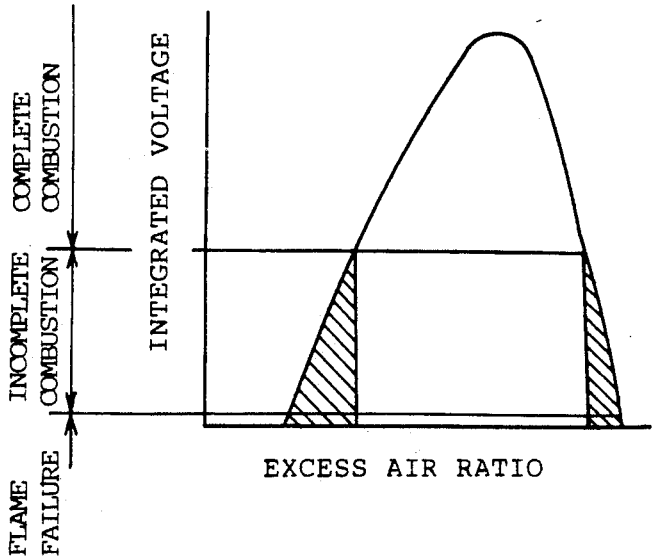
FIG. 2 is a graph showing the relationship between the combustion state and the excess air ratio.

As shown in FIG. 2, the rectified integrated voltage reaches a maximum when the excess air ratio is at a certain level. When the quantity of combustion air is lower than that level, the oxidation reaction is slow due to a failure in mixing with the fuel as a result of the decrease in the amount of oxygen. When the quantity of combustion air is excessively large, the flame is cooled by the air, resulting similarly in slow oxidation reaction. In such a case, incomplete combustion gas is generated, and the integrated voltage lowers. Thus, it is possible to decide whether the combustion state is normal or incomplete by previously measuring a rectified integrated voltage corresponding to the excess air ratio in which incomplete combustion occurs, and comparing this voltage with an integrated voltage measured during actual combustion. In addition, when a flame failure occurs, no light oscillating signal is available, so that the rectified integrated voltage is 0. Accordingly, it is also possible to detect a flame failure.

Figure 3:
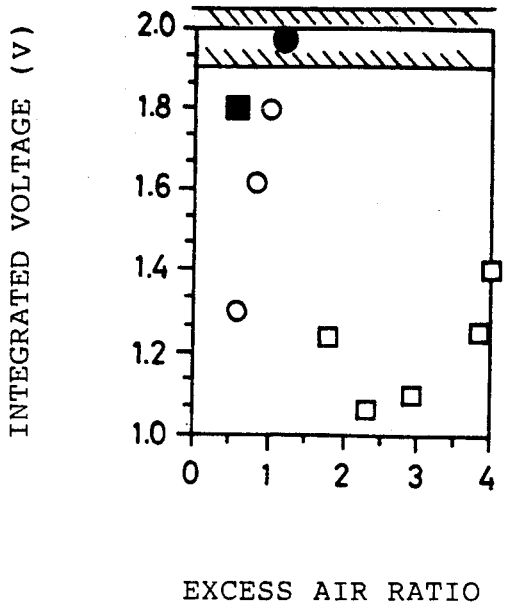
FIG. 3 is a graph showing the relationship between the integrated voltage and the excess air ratio.
Figure 4:
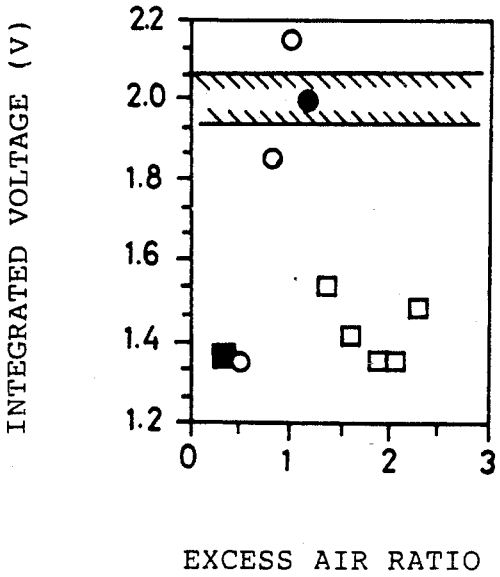
FIG. 4 is a graph showing the relationship between the integrated voltage and the excess air ratio.

The relationship between the excess air ratio and the rectified integrated voltage in this control system is such as that shown in FIGS. 3 and 4. More specifically, FIG. 3 shows characteristics of the integrated voltage obtained in a combustion operation at a burning rate of 94,000 kilocalories/hour by a burner of 300,000 kilocalories/hour, whereas FIG. 4 shows the characteristics at a burning rate of 174,000 kilocalories/hour by the same burner. In these figures, the white circles show results obtained when the pressure of combustion air supplied to the burner was varied with the burning rate maintained at a constant level.

Figure 5:
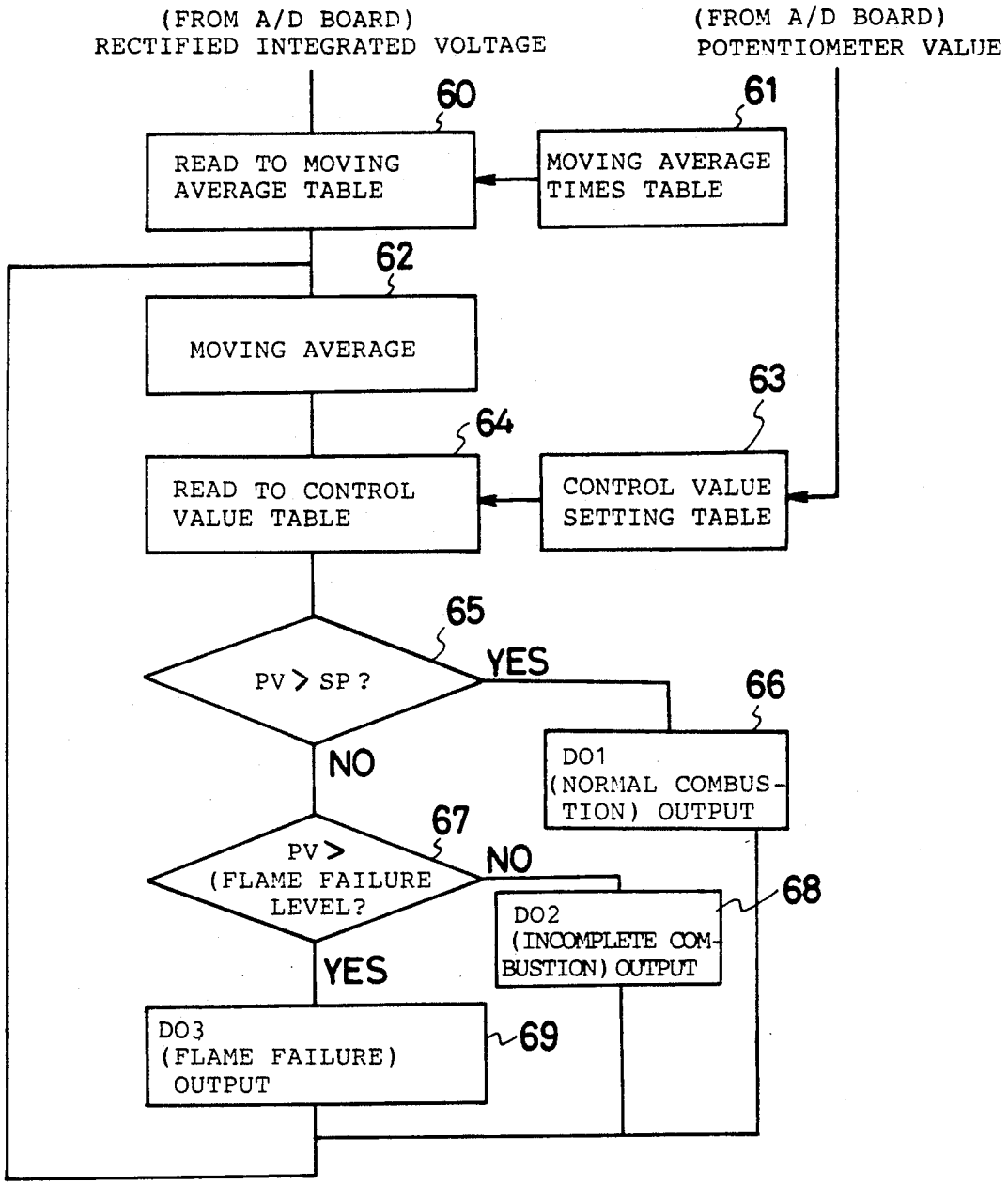
FIG. 5 is a flowchart showing an operation of a digital circuit unit in the arrangement shown in FIG. 1.

In FIGS. 3 and 4, the white squares show results obtained when the opening of the air control valve was varied with the pressure of air supplied to the burner maintained at a constant level. The black circles show excess air ratio points obtained after the initial combustion control was effected, whereas the black squares show integrated voltage values obtained at the time of gas-rich combustion carried out with the air control valve fully closed. Although the characteristics are not such as those shown in FIG. 2, which are obtained when the whole flame is detected from behind, it is possible to detect a combustion state even when the pressure of combustion air supplied to the burner changes due to some abnormality or when incomplete combustion occurs due to air-rich or gas-rich condition by controlling the rectified integrated voltage (shown by the black circle in each figure) in the present air-fuel ratio within the hatched range, as shown in FIGS. 3 and 4. In this case, however, the control value setting table at Step 63 in the flowchart shown in FIG. 5 needs to be replaced with a high-limit and low-limit setting table shown in FIG. 6, and a voltage signal (process value; hereinafter referred to as "PV") obtained by moving average (Step 62) needs to be set to a value which is smaller than the high-limit value and larger than the low-limit value at Step 65.

The arithmetic operation of the digital circuit unit 55 will next be explained. Analog signals input to the digital circuit unit 55 from the integrator 54 in the analog circuit unit and from the potentiometer 44 are converted into digital signals in an A/D converter inside the digital circuit unit 55 and then subjected to processing such as that shown in the flowchart of FIG. 5 in a CPU. More specifically, the rectified integrated voltage signal, which has been A/D converted, is first read to a moving average times table (Steps 60 and 61) where it is subjected to moving average a number of times previously set in the moving average times table, thereby obtaining a time constant, and thus smoothing variations of data.

Figure 6:
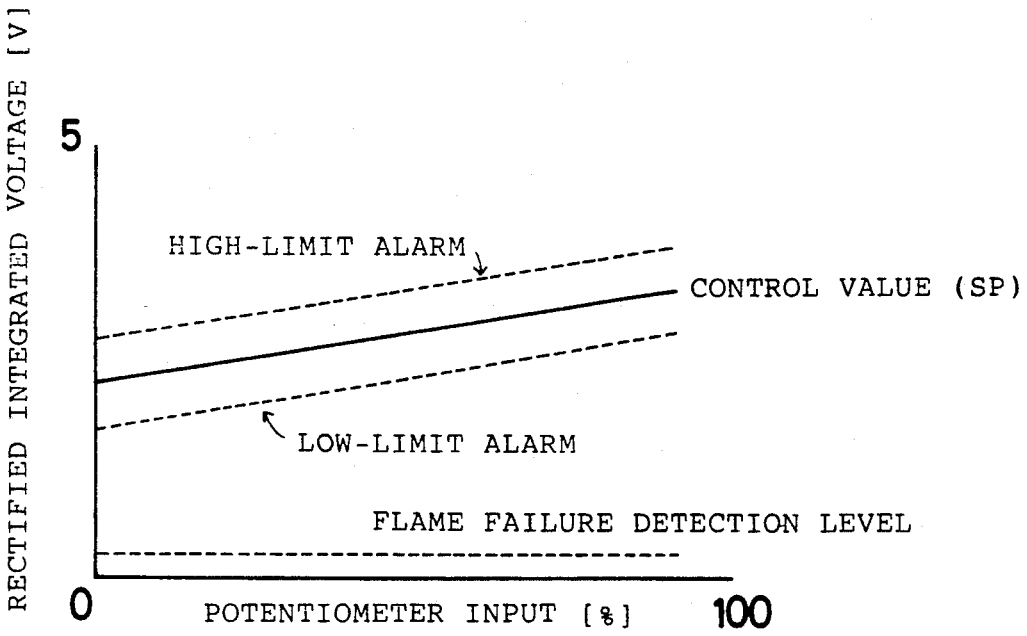
FIG. 6 is a graph showing a control value setting range.
Figure 7:
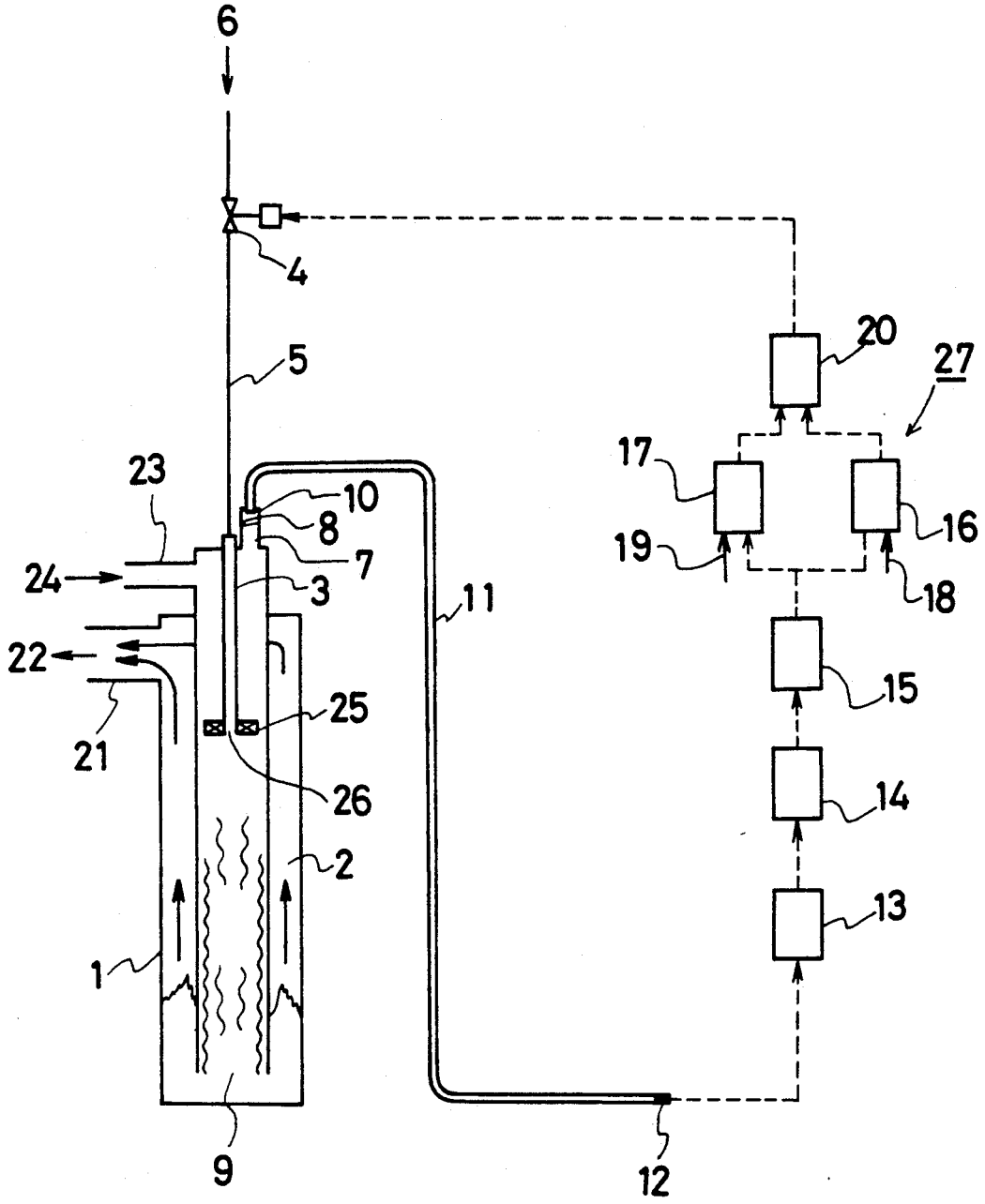
FIG. 7 RELATED ART
FIG. 7 is a circuit diagram of a prior art.

The number of times of averaging may be set to a any desired value in conformity to combustion equipment to which the control system of the present invention is applied. As to PV, the A/D converted potentiometer signal (fuel flow rate) is read to a control value setting table (Steps 63 and 64) where it is compared with a reference value (i.e., set point; hereinafter referred to as "SP") preset in correspondence to each combustion rate, as shown in FIG. 6. When PV is larger than SP, the combustion state is decided to be the complete combustion shown in FIG. 2 (Steps 65 and 66), and then a contact output (i.e., digital output; hereinafter referred to as "DO") DO1 (normal combustion) is turned on, whereas, when PV is smaller than SP and larger than the flame failure level, the combustion state is decided to be the incomplete combustion shown in FIG. 2, and then DO2 is turned on (Steps 67 and 68). The flame failure level may be set to any desired value. When PV is smaller than both SP and the flame failure level, the combustion state is decided to be the flame failure shown in FIG. 2, and then DO3 is turned on (Step 69).

In the circuit shown in FIG. 1, the burner 28 is supplied with a fuel oil and combustion air from the fuel supply pipe 29 and the air supply pipe 30. When the burner 28 is ignited, the thermoregulator 47, to which a signal from the temperature sensor 46 is input, controls the fuel flow control valve 33 so that the temperature in the furnace is maintained at a constant level. This is effected by controlling the fuel flow control arm 34 by the control motor 41 through the rod 40. Since the air flow control arm 37 of the air flow control valve 36 for the burner 28 is connected to the rod 39 of the fuel flow control arm 34 through the rod 39, the quantity of air supplied is controlled in a predetermined ratio to the quantity of fuel supplied at all times.

Even when the rod 40 that connects together the control motor 41 and the fuel, flow control valve 33 comes off for some reason, no particular problem will arise in terms of safety, but when the rod 39 that connects together the fuel flow control arm 34 and the air flow control arm 37 comes off, a gas-rich condition is likely to occur, which gives rise to a problem concerned with safety. For this reason, the arm 45 of the potentiometer 44 for obtaining a degree of opening of the fuel flow control valve 33 is connected to the air flow control arm 37 through the rod 43. Thus, even if the rod 39 that connects together the fuel flow control arm 34 and the air flow control arm 37 comes off for some reason and the air flow control arm 37 fully closes the air flow control valve 36 by its own weight, the potentiometer 44, which is connected thereto through the arm 45, operates in response to the movement of the air flow control arm 37, causing the control value to change. As a result, PV comes out of the control range in the high-limit and low-limit table, thus enabling the abnormality to be detected.

As has been described above, the burner combustion control system of the present invention comprises: an analog circuit unit including a photosensor for detecting combustion flame of the burner, an amplifier for amplifying a detection output from the photosensor, a rectifier for rectifying the amplified signal to a DC component, and an integrator for smoothing the rectified signal to obtain an oscillating power signal; a potentiometer for generating an output voltage corresponding to a degree of opening of a fuel flow control valve of the burner; a digital circuit unit supplied with an output signal from the potentiometer and an output signal from the integrator to compare these signals with a plurality of preset combustion state reference values and to display as well as output one of three different kinds of signal, that is, a normal combustion state signal, an incomplete combustion state signal or a flame failure signal, in accordance with the result of the comparison; and a controller for outputting to the burner either a burner combustion maintaining or suspending command signal on the basis of the output signal from the digital circuit unit. Accordingly, the control system can be applied to a burner with a turndown ratio, which has heretofore been impossible to control by the prior art. In addition, since setting of a time constant, a control value and a flame failure level can be effected on software, these can be set readily and with high resolution. Thus, even for a burner in which the combustion rate is variable, it is possible to detect a combustion state in a range suitable therefor.

Although the present invention has been described through specific terms, it should be noted here that the described embodiment is not necessarily exclusive and that various changes and modifications may be imparted thereto without departing from the scope of the invention which is limited solely by the appended claims.

What is claimed is:

1. A combustion control system for a burner, comprising:

an analog circuit unit including a photosensor for detecting combustion flame of said burner, an amplifier for amplifying a detection output from said photosensor, a rectifier for rectifying said amplified signal to a DC component, and an integrator for smoothing said rectified signal to obtain an oscillating power signal;

a potentiometer for generating an output voltage corresponding to a degree of opening of a fuel flow control valve of said burner;

a digital circuit unit supplied with an output signal from said potentiometer and an output signal from said integrator to compare these signals with a plurality of preset combustion state reference values and to output a normal combustion state signal, an incomplete combustion state signal or a flame failure signal in accordance with the result of the comparison; and a controller for outputting either a burner combustion maintaining signal or a burner combustion suspending signal on the basis of said output signal from said digital circuit unit.

2. A combustion control system according to claim 1, wherein said burner is a radiant tube burner.

3. A combustion control system according to claim 1 or 2, wherein a control arm for said potentiometer and a control arm for said fuel flow control valve are mechanically interlocked with each other through a control arm for an air flow control valve included in said burner.

4. A combustion state detector for a burner, comprising:

an analog circuit unit including a photosensor for detecting combustion flame of said burner, an amplifier for amplifying a detection output from said photosensor, a rectifier for rectifying said amplified signal to a DC component, and an integrator for smoothing said rectified signal to obtain an oscillating power signal;

a potentiometer for generating an output voltage corresponding to a degree of opening of a fuel flow control valve of said burner; and a digital circuit unit supplied with an output signal from said potentiometer and an output signal from said integrator to compare these signals with a plurality of preset combustion state reference values and to display as well as output a normal combustion state, an incomplete combustion state or a flame failure in accordance with the result of the comparison.

5. A combustion state detector according to claim 4, wherein a control arm for said potentiometer and a control arm for said fuel flow control valve are mechanically interlocked with each other through a control arm for an air flow control valve included in said burner.

* * * * *